United States Patent [19]

Allen et al.

[11] 4,257,627

[45] Mar. 24, 1981

[54] CONTINUOUS BUSINESS FORM

[75] Inventors: Robert H. Allen, North Tonawanda, N.Y.; Alan M. Gould, Wassenaar, Netherlands

[73] Assignee: Moore Business Forms, Inc., Grand Island, N.Y.

[21] Appl. No.: 36,491

[22] Filed: May 7, 1979

Related U.S. Application Data

[63] Continuation-in-part of Ser. No. 916,414, Jun. 16, 1978, which is a continuation of Ser. No. 619,466, Oct. 3, 1975, which is a continuation of Ser. No. 560,479, Mar. 20, 1975, which is a continuation of Ser. No. 387,447, Aug. 10, 1973, abandoned.

[51] Int. Cl.[3] ..... B42D 15/00

[52] U.S. Cl. ..... 283/66 R; 283/66 A

[58] Field of Search ..... 283/1 R, 1 A, 36, 66 R, 283/66 A

[56] References Cited

U.S. PATENT DOCUMENTS

| | | | |
|---|---|---|---|
| 1,573,902 | 2/1926 | Baskerville | 283/1 R |
| 2,832,611 | 4/1958 | Prosser | 283/66 R |

FOREIGN PATENT DOCUMENTS

| | | | |
|---|---|---|---|
| 815415 | 6/1969 | Canada | 283/66 A |

OTHER PUBLICATIONS

Moore Computer Printout Forms 7/72 copy, part of preamendment filed 10/3/75 in Ser. No. 619,466.

*Primary Examiner*—Paul A. Bell

*Attorney, Agent, or Firm*—Allegretti, Newitt, Witcoff & McAndrews

[57] ABSTRACT

A continuous business form has rows of aligned feed holes along opposite side margins for feeding the form through a data printer which simultaneously prints a complete line of type across the form. A plurality of parallel pre-printed bars of pre-selected bright and clear halftone colors extend across the form, each bar being of a constant width substantially equal to the pitch of the line of type across the form. The bars are printed on a bright white substrate and have a width of at least one-eighth inch so as to permit at the least eight lines per inch of type to be printed on the form. The bars are of at least two different repeating colors and of such a spacing as to effectively avoid confusion and minimize eye fatigue when reading lines of type spaced as closely as eight or more per inch.

2 Claims, 4 Drawing Figures

CONTINUOUS BUSINESS FORM

BACKGROUND OF THE INVENTION

This is a continuation-in-part of co-pending application Ser. No. 916,414 filed June 16, 1978, which is a continuation of application Ser. No. 619,466, filed Oct. 3, 1975, which was a continuation of application Ser. No. 560,479, filed Mar. 20, 1975, which was a continuation of Ser. No. 387,447 filed Aug. 10, 1973, and now abandoned.

This invention relates generally to continuous business forms, and more particularly to such a form as having differently colored pre-printed parallel bars thereon to avoid confusion between closely spaced lines of type as one line is read across the form.

In printing continuous computer forms, a high-speed business machine successively prints lines of type in several rows across the form as it moves in the direction of the feed through the printer. Adequate spacing between the lines of type must be maintained so that one line is not confused with an adjacent one while reading the form. Obviously, fewer lines per inch requires the use of more paper for the same information thereby resulting in increased paper costs for the customer and an inefficient use of the computer paper. On the other hand, if less spacing is maintained between the printed lines of type, the reader must resort to the use of a straight edge or some other guide in reading each line across the form lest he confuse one for the other. Furthermore, the reader may eventually suffer from the effects of astigmatism as his vision becomes blurred while reading large numbers of printed lines of type closely spaced together.

Forms have been provided in the past using parallel pre-printed bars of a single color of between one-sixth and one-half inch width equally spaced to accommodate six lines of type per inch in the direction of feed. The bars normally consisted of full value printed lines closely spaced horizontally across the form, or of stippling. This arrangement did not, however, effectively eliminate confusion in reading one line of type across the form, nor did it serve to avoid eye fatigue and the effects of astigmatism normally occurring when reading large numbers of lines for long periods of time.

SUMMARY OF THE INVENTION

This invention seeks to improve upon the use of continuous computer forms by allowing for easily readable and quickly discernible printed lines of type spaced as closely as at least eight lines per inch on the form.

The present invention also seeks to provide such a business form as having a plurality of parallel pre-printed bars of at least two pre-selected bright and clear half tone colors repeatedly extending across the form, each bar being of a constant width substantially equal to the pitch of the line of type printed on the form, and the bars being equally spaced apart in one embodiment a distance equal to such width with each bar and the spaces therebetween being in alignment with successive ones of the lines of type printed by the printing devices. Every other printed bar may be of the same color tone with alternate printed bars being of a different color tone so as to permit any one line of type to be clearly read across the form without confusing it with an adjacent line of type even though eight lines of type or more are provided on the form per inch of spacing.

Still further, this invention provides such a business form wherein one of the colors referred to is a Pantone 474 color designation, and the other of said referred-to colors is a Pantone 571 color designation with the spacings therebetween being of bright white color to thereby facilitate a clear distinction of one bar from the other, and an easy and eye-soothing reading of a line of type across the form without confusion or without the need for a guide marker.

DESCRIPTION OF THE DRAWINGS

Other objects, advantages and novel features of the invention will become apparent from the following detailed description of the invention when taken in conjunction with the drawing wherein.

DETAILED DESCRIPTION OF THE INVENTION

Figures 1, 2, 3:
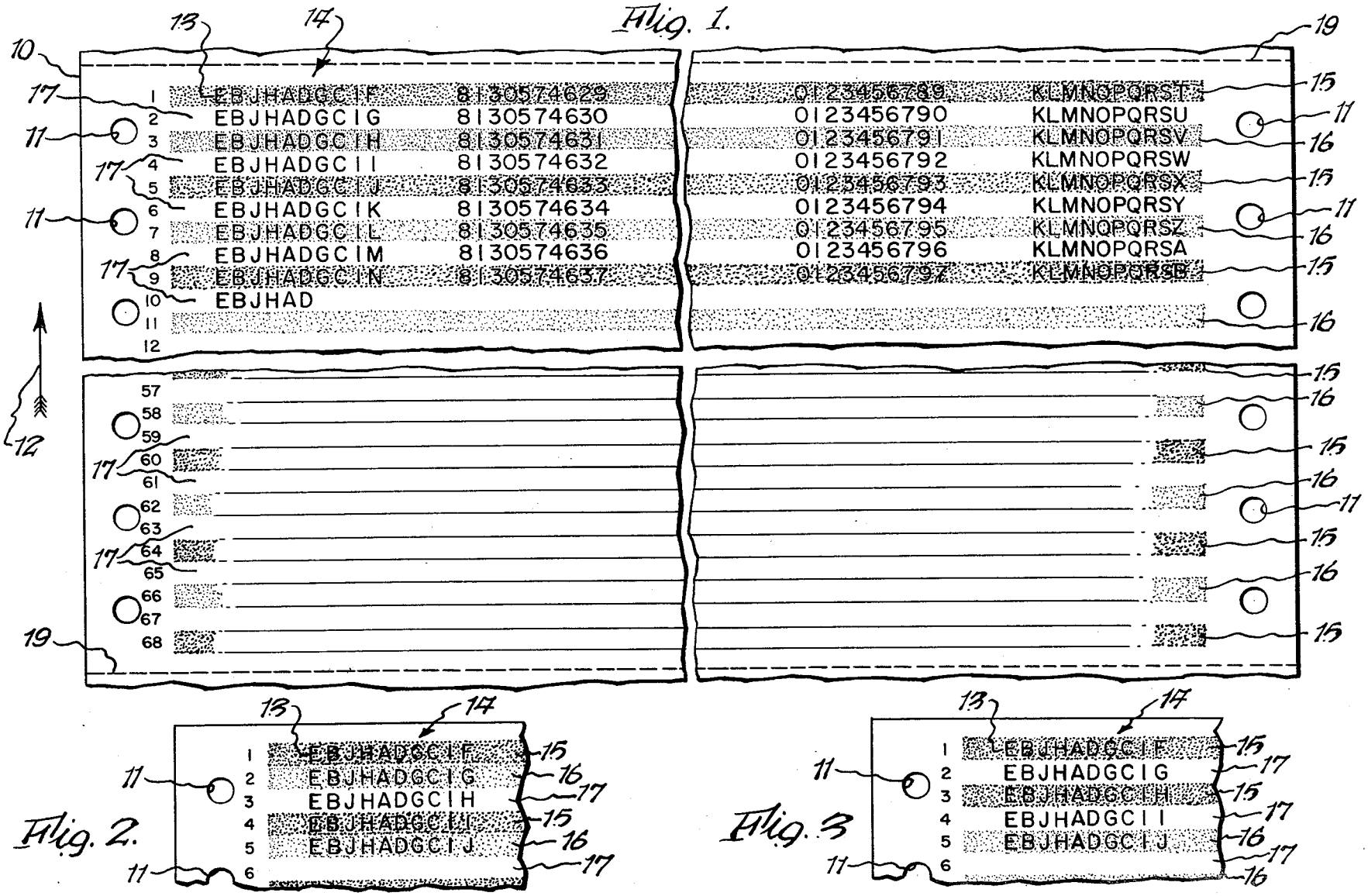
FIG. 1 is a plan view of part of one embodiment of a continuous business form in accordance with the present invention.
FIGS. 2 and 3 are views each similar to FIG. 1 showing other embodiments of the invention.

In the drawings wherein like reference characters refer to like and corresponding parts throughout the views, part of a continuous business form section 10 is shown in FIG. 1 as having rows of aligned feed holes 11 provided along opposite side margins thereof for feeding the form through a data printer in the direction of feed shown by the arrow 12. The form is of the continuous type and the data printer normally has a series of selectively changeable printing devices, one for each character space in a line and arranged in a row so as to simultaneously print complete lines of type 13 along form lines 1 through 68 on each form section. Such a form section is defined by lines of weakening 19 extending across the top and bottom margins thereof. Columns such as 14 are printed on the form across each line. In this example, nine columns 14 of ten characters each are printed on a form section such as 10 shown in the drawings. It should be noted, however, that any number of characters may be used in the columns without departing from the spirit of the present invention.

In accordance with one embodiment of the invention, each section of form 10 is provided with a plurality of pre-printed parallel bars 15 and 16, each of constant width and extending along the form substantially between the opposite side margins thereof. One preselected color is made for bars 15 which can be seen to alternate with bars 16 in FIG. 1 for which another preselected color is made. Each of the bars 15 and 16 is formed by stippling or dots, using a half tone process of bright and clear color inks having a tonal value as close as possible to a 20% lithographic screen or an 85%-line 17% letterset screen. Such half tone character is therefore lighter than the lines of solid characters 13 printed thereon by the high-speed printer.

Also, the color selected for bars 15 is a Pantone 571 color designation and the color selected for bars 16 is a Pantone 474 color designation. The Pantone (Registered Trademark) matching system is a well-recognized standard of designating accurate color hues for all the colors in the visible spectrum. The Pantone 571 color and the Pantone 474 color is therefore believed to most accurately identify the green and reddish-yellow tones selected for bars 15 and 16, respectively.

Each of the pairs 15 and 16 is of a constant width substantially equal to the pitch of the characters in the line of type printed on the form. Also, each of the bars in FIG. 1 are spaced apart a distance equal to the pitch of these characters printed on the form. The bars and spacings therebetween are in alignment with successive ones of the lines of type printed by the printing devices on the form as the form is moved in the direction 12 of feed through the printer .

Bars 15 and 16 are pre-printed on a substrate defining form section 10 which is of a bright white color. Each of the bars is therefore separated by spacings 17 of such bright white color, and alternate bars are pre-printed using the two aforedescribed colors. These particular green and reddish-yellow colors are used because they are complements on the color wheel, i.e. they are compatible in an aesthetic sense, which aid the reader in following any one specific line of type across the form without confusing it with another. This eliminates some of the effects of astigmatism and confusion between lines of type when read across the form. Also, the reader becomes easily acclimated to this color combination since it recurs often in nature, thereby resulting in a reduction of eye fatigue. The bright green color of dots or stipplings produced by the aforedescribed halftone process is therefore selected for form lines "1", "5", "9" and so on, alternating with bars 16 at form lines "3", "7", "11" and so on between the top and bottom margins of the form section.

As an alternative, bars 15 and 16 may be disposed directly adjacent one another, green bars 15 being paired with reddish-yellow bars 16 between the top and bottom margins of the form section, and the pairs being spaced from one another as shown partly in FIG. 2. Bars 15 are therefore selected for form lines "1" and "4" and so on, alternating with bars 17 at form lines "2" and "5", etc. Bars 15 and 17 are printed on the bright and clear white substrate similarly as in the FIG. 1 embodiment except that they are arranged differently in the manner described above.

In another embodiment shown in FIG. 3 bars 15 are provided in spaced pairs separated from bars 16 also provided in spaced pairs alternately with bar pairs 15.

Other arrangements of bars 15 and 16 are made possible within the scope of the invention. For example, three bars of one color each having spaces 17 therebetween may be followed by a single bar of the other color at a spacing 17 therefrom. Moreover, other colors for bars 15 and 16 than those specifically disclosed herein may be selected so long as they are of such complements on the color wheel and are of such tonal quality as to permit the reader to follow one line of type across the form without confusing it with another and without the effects of eye fatigue during reading.

When spacing of the bars becomes more compressed, i.e., the number of bars per inch increases, it becomes increasingly important to provide further means whereby to guide the eye during a reading-search of material entered on the form. One way by which this may be done is to add additional colored inks whereby additional colored lines may be printed on the form. The additional colored lines provide further separation of data guide means by increasing the number of lines between the same colored line.

Certain economic factors limit the indiscriminate and arbitrary addition of differently colored ink bars to the form. Each ink color which is added to the form requires an additional holding pot with the attendant problems of purchasing, suppliers, cleanup, etc. Thus, to eliminate or substantially reduce these attending problems, a blend of the two starting colors is used, i.e., if two colored inks are being used to print the bars on a form, one ink is applied to the first and fifth bar with the second ink being applied to the third and fifth bar, thus providing a blended color in the fifth bar. Thus, a color separation of six bars is achieved before repeat of the same colored ink bar when using only two colored inks. Extending the process further, if three differently colored inks were used, three blends could be achieved with a separation of twelve bars before repeat of the same colored ink bar. Accordingly, it is readily seen that the addition of each color produces increasing multiples of color blends and line separations with only small increase in the aforementioned economic considerations.

Figure 4:
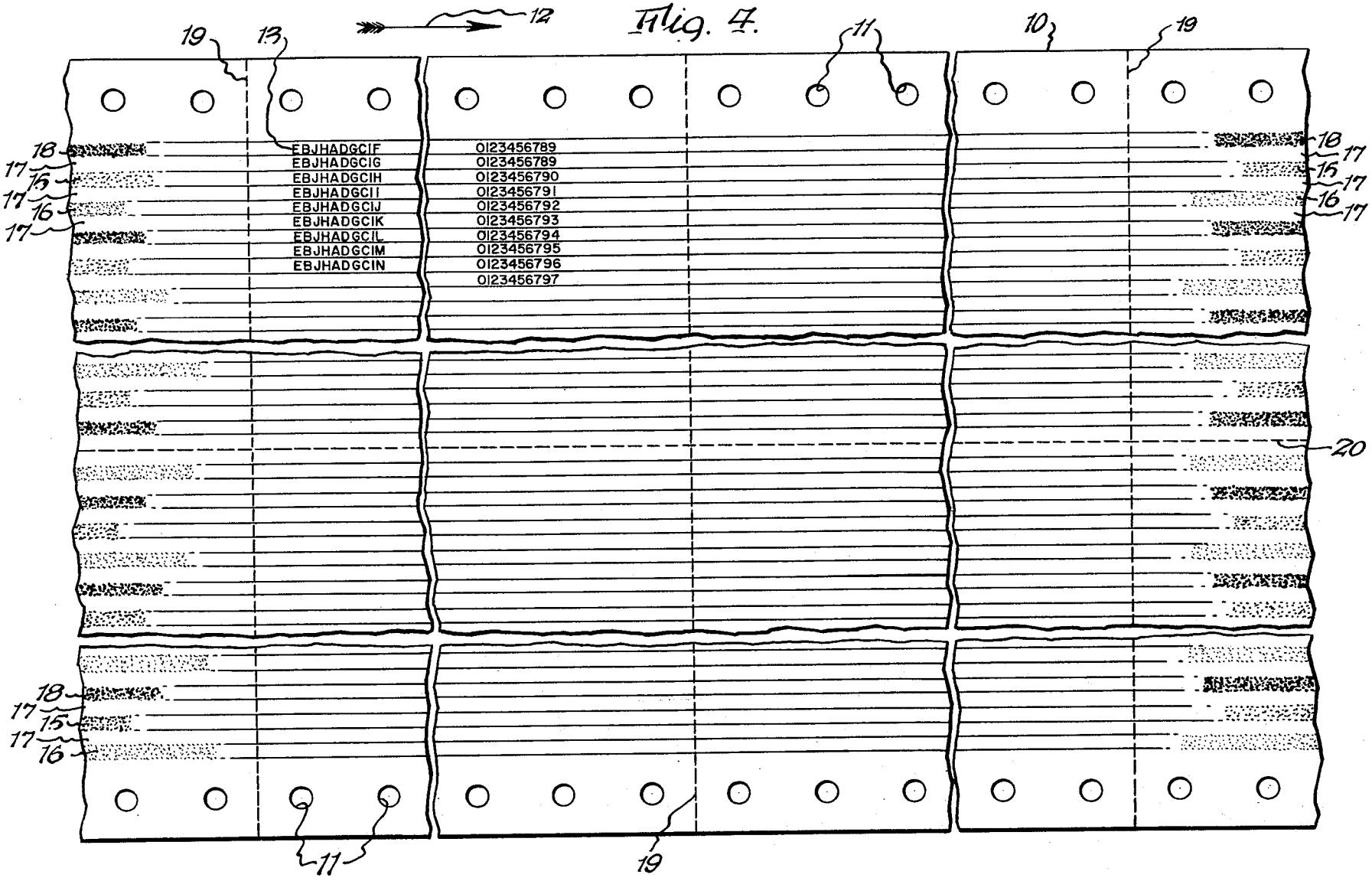
FIG. 4 is a plan view showing a further embodiment in which parallel lines or bars are longitudinally arranged.

In a further embodiment of the present invention, FIG. 4 illustrates a 90° rotation of the colored bars on form 10 from the transverse direction of feed shown in FIG. 1. This form is particularly suitable for high-speed non-impact printers. Rows of aligned feed holes 11 feed the form in the longitudinal direction of the bars shown by arrow 12. As the form moves through the non-impact printer, type 13 is printed along bars 15–18.

FIG. 4 further illustrates the embodiment wherein two colored bars 15 and 16 are pre-printed on light substrate defining bar 17 of form 10. Bar 18 is a blend of colors used for bars 15 and 16 in which the tonal quality is adjusted to substantially the same density as the other bars. All the bars are of constant width and extending along the form substantially between lines of weakening 19. For certain purposes, form 10 may have the bars oriented parallel to lines of weakening as shown in FIG. 4; while for other applications, the bars may be oriented parallel to lines of weakening 19 as shown in FIG. 1.

From the foregoing, it can be seen that a highly effective technique is used in allowing eight lines of type per inch or more to be printed on the continuous form sections while at the same time substantially eliminating any confusion between lines as the reader follows an intended line of type on the form. Heretofore, only as many as 3 to 5 lines of type per inch were made possible because of the need for adequately spacing the lines of type apart on an all-white substrate so as to avoid confusion between lines when reading across the form. Despite the large number of lines of type per inch printed on each form section with the present invention, the eye of the reader is able to easily and quickly follow any intended line of type completely on the form without confusing it with any other line of type and without ultimately suffering from eye fatigue or the effects of astigmatism in the process of reading large numbers of lines at one time. Selections of green and reddish-yellow colors of the above-noted type for the respective bars 15 and 16 is of importance since it is these colors which have been found to enhance the interpretability of the eight lines per inch or more spacing, reduce eye fatigue of the reader and permit the use of a more useful printout in the same space of the form as it is run through the data printer.

Obviously, many modifications and variations of the present invention are made possible in the light of the above teachings. It is therefore to be understood that within the scope of the appended claims, the invention may be practiced otherwise than as specifically described.

What is claimed is:

1. In a continuous business form having a surface adapted to be imprinted with characters of a predetermined size, said form having lines of weakening whereby said form may be subdivided into uniform sets having rows of feed holes extending along at least one side margin thereof, a plurality of continuous parallel bars of at least three different and unlike colors, one of which is lighter than the other two colors, said bars occupying a substantial part of said area of said surface with individual ones of said bars extending across said form for the optional printing of characters across substantially all of the width of said bars in random manner; said bars having a dimension of at least equal to but not less than twice the height of said characters so that a single line of characters may be printed on said bars, said bars being spaced repetitively along said form in such manner so that said lighter color bars are spaced alternately and any sequence of said bars includes bars of at least three different colors whereby a line of characters printed on one bar will be clearly distinguishable from lines of characters printed on adjoining bars on said surface of said form, an improvement in said form comprising wherein said colored bars comprise at least two darker colors and a third color bar which is a blend of the two darker colors.

2. In a continuous business form having a surface adapted to be imprinted with characters of a predetermined size, said form having lines of weakening whereby said form may be subdivided into uniform sets having rows of feed holes extending along at least one side margin thereof, a plurality of continuous parallel bars of at least three different and unlike colors, one of which is lighter than the two other colors, said bars occupying a substantial part of said area of said surface with individual ones of said bars extending across said form for the optional printing of characters across substantially all of the width of said bars in random manner; said bars having a dimension of at least equal to but not less than twice the height of said characters so that a single line of characters may be printed on said bars, said bars being spaced repetitively along said form in such manner so that said lighter color bars are spaced alternately and any sequence of said bars includes bars of at least three different colors whereby a line of characters printed on one bar will be clearly distinguishable from lines of characters printed on adjoining bars on said surface of said form, an improvement in said form wherein said bars are longitudinal to said row of feed holes.

* * * * *

UNITED STATES PATENT AND TRADEMARK OFFICE

CERTIFICATE OF CORRECTION

PATENT NO. : 4,257,627

DATED : March 24, 1981

INVENTOR(S) : Robert H. Allen and Alan M. Gould

It is certified that error appears in the above-identified patent and that said Letters Patent are hereby corrected as shown below:

In both column 5, line 16, and column 6, line 15, delete the word "not".

Signed and Sealed this

*Twenty-first* Day of *July 1981*

[SEAL]

*Attest:*

GERALD J. MOSSINGHOFF

*Attesting Officer*

*Commissioner of Patents and Trademarks*